US008146195B2

(12) United States Patent
Yu

(10) Patent No.: US 8,146,195 B2
(45) Date of Patent: Apr. 3, 2012

(54) CLEANING DEVICE

(76) Inventor: Tsung Mou Yu, Taipei (TW)

( * ) Notice: Subject to any disclaimer, the term of this patent is extended or adjusted under 35 U.S.C. 154(b) by 529 days.

(21) Appl. No.: 12/489,424

(22) Filed: Jun. 22, 2009

(65) Prior Publication Data

US 2010/0319148 A1 Dec. 23, 2010

(51) Int. Cl.
*A47L 13/10* (2006.01)

(52) U.S. Cl. ..... 15/97.1; 15/105; 15/115; 15/229.6

(58) Field of Classification Search ..... 15/21.1, 15/97.1, 98, 105, 114, 115, 146, 159.1, 185, 15/229.6, 244.2
See application file for complete search history.

(56) References Cited

U.S. PATENT DOCUMENTS

2007/0234492 A1* 10/2007 Svendsen et al. ..... 15/21.1
* cited by examiner

*Primary Examiner* — Shay Karls
(74) *Attorney, Agent, or Firm* — Lin & Associates IP, Inc.

(57) ABSTRACT

A cleaning device includes a case. A collection box is located in the case and the collection box includes an entrance with a door pivotally sealing the door. Two cleaning disks are connected to an underside of the case and driven by two gears connected to a roller. Each of the cleaning disks has multiple brushes so as to sweep dust into the collection box. A handle is connected with a yoke member which is pivotally connected to the case and a mopping unit is connected to the case and enclosed by a frame which is movable up and down to allow the brushes to contact the floor when use. The case is pivoted 180 degrees to allow the mopping unit to be located to mop the floor.

13 Claims, 7 Drawing Sheets

CLEANING DEVICE

BACKGROUND OF THE INVENTION

1. Field of the Invention

The present invention relates generally to a cleaning device, and in particular to a cleaning device having functions of mopping and sweeping.

2. The Prior Arts

There are many sweeping devices available in the market and one of the latest sweeping devices includes rollers which allow the device to move on the floor and two circular brooms are rotated to collect dust into a collection box which is connected to the device. However, the collection box includes an open entrance and the dust may drop from the entrance and back to the floor. Besides, floor cleaning includes sweeping and mopping. In other words, the conventional sweeping devices cannot complete the two different tasks, and thus a user has to prepare an extra mop which occupies a certain space in the storage room.

Applicant discloses a cleaning device of the present invention to overcome the shortcomings found in the conventional cleaning devices. The cleaning device according to the present invention can sweep and mop the floor. The users do not need to separately prepare a sweeper and a mop. The connection box includes a door which prevents dust in the collection box from dropping back to the floor.

SUMMARY OF THE INVENTION

A primary objective of the present invention is to provide a cleaning device that has a sweeping function and a mopping function. Another objective of the present invention is to provide a cleaning device capable of preventing dust from dropping out from the cleaning device.

In order to achieve the objectives, a cleaning device according to the present invention includes a case, a handle unit, a cleaning unit, a wheel unit and a mopping unit. The case has a sweeping space and a chamber which is located corresponding to the sweeping space. A collar is mounted to the case and the handle unit is pivotally connected to the case by a yoke member.

The cleaning unit has an elongate roller and the roller has a plurality of plates extending radially therefrom. The roller is pivotally connected to the case and two gears are connected to the roller. Two cleaning disks driven by the gears are connected to an underside of the case and each of the cleaning disks has multiple brushes. A collection box is received in the chamber and has an entrance which faces the sweeping space.

The wheel unit has a plurality of shanks and wheels connected to the shanks. The shanks pass through openings of the case and are disposed at the same side of the cleaning unit. The shanks are pivotally connected to a first slot defined in a first link which is connected to the case. A first end of the first link is pivotally connected to a second slot defined in a first end of a second link. A second end of the first link is pivotally connected to the first pivotal position of the case. A second end of the second link is connected with a transverse rod which has a plurality of pushers to push a door of the collection box.

A mopping unit has a board with multiple mopping members connected thereto and the board is connected to the collar of the case. The mopping members can be fabric braids or a sponge.

When the cleaning unit contacts the floor, the shanks and the wheels contact the floor and push the case upward so as to activate the first and second links to push open the door of the collection box by the pushers on the transverse rod. In the meanwhile, the shanks also push the frame upward and the shanks move to the ribs via the inclined surfaces. Because the ribs have a certain thickness so that the wall pieces on the frame are deformed inward about the groove when the frame encloses the wall pieces. The mopping members are then restricted by the wall pieces and do not affect the sweeping action. The user then moves the case and the teeth contact the floor and rotate the gears, the cleaning disks are rotated to brush dust into the collection box. The plates on the roller are rotated and keep the dust from spreading. When the collection box is full, the user may remove the connection box from the chamber to clean the collection box.

After sweeping, the case is rotated 180 degrees to allow the mopping unit to face the floor. The frame returns to its original position because the springs move the shanks away from the case. The mopping members are released from the restriction ring and can be used to mop the floor. The board of the mopping unit can be connected to or remove from the case so as to be replaced or to clean the mopping members. The pivots on the yoke member are connected to the second pivotal positions of the case so that the user can hold the handle and operate the cleaning device. When the user lifts the case, the wheels and the shanks pushes the door to close the entrance of the collection box because of the springs located between the shaft and the end rods. The shanks and the wheels are then protruded beyond the case. The door prevents the dust in the collection box from dropping out from the entrance. The collection box can be removed from the case via the chamber.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
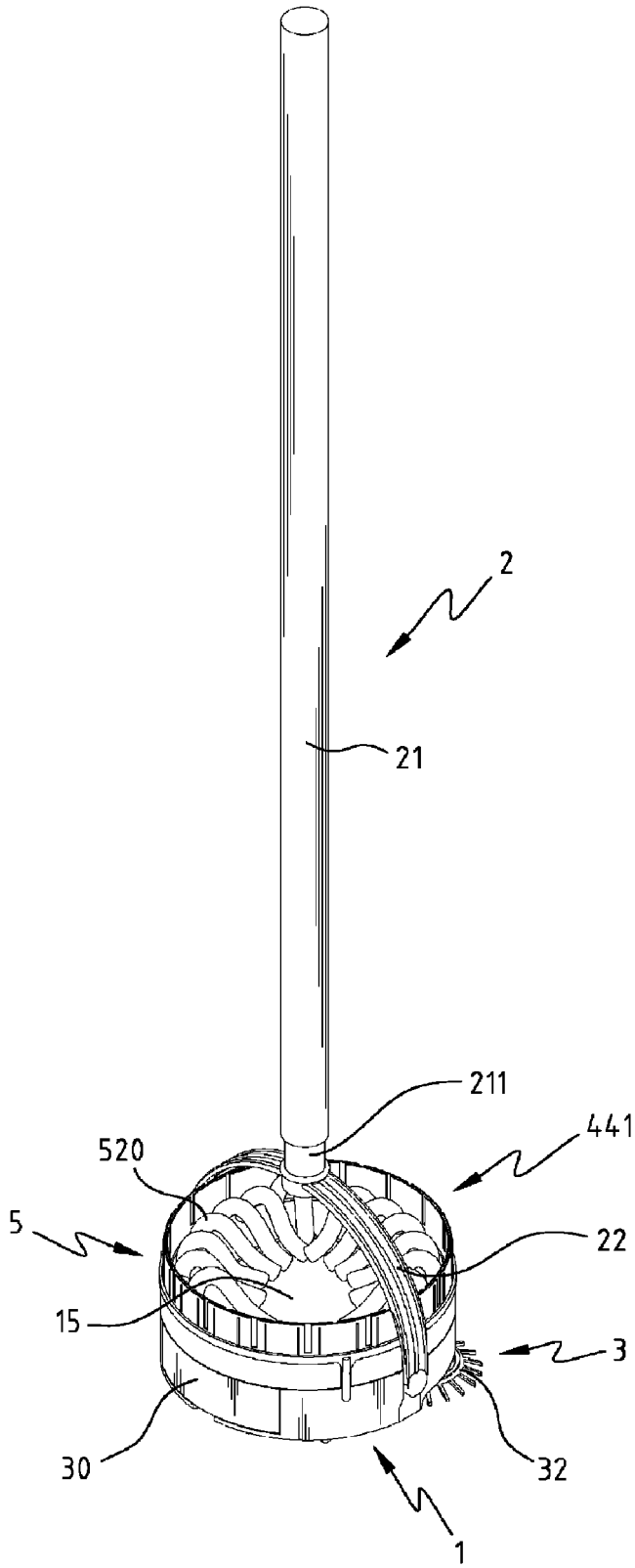
FIG. 1 is a perspective view showing a cleaning device in accordance with an embodiment of the present invention.
Figure 2:
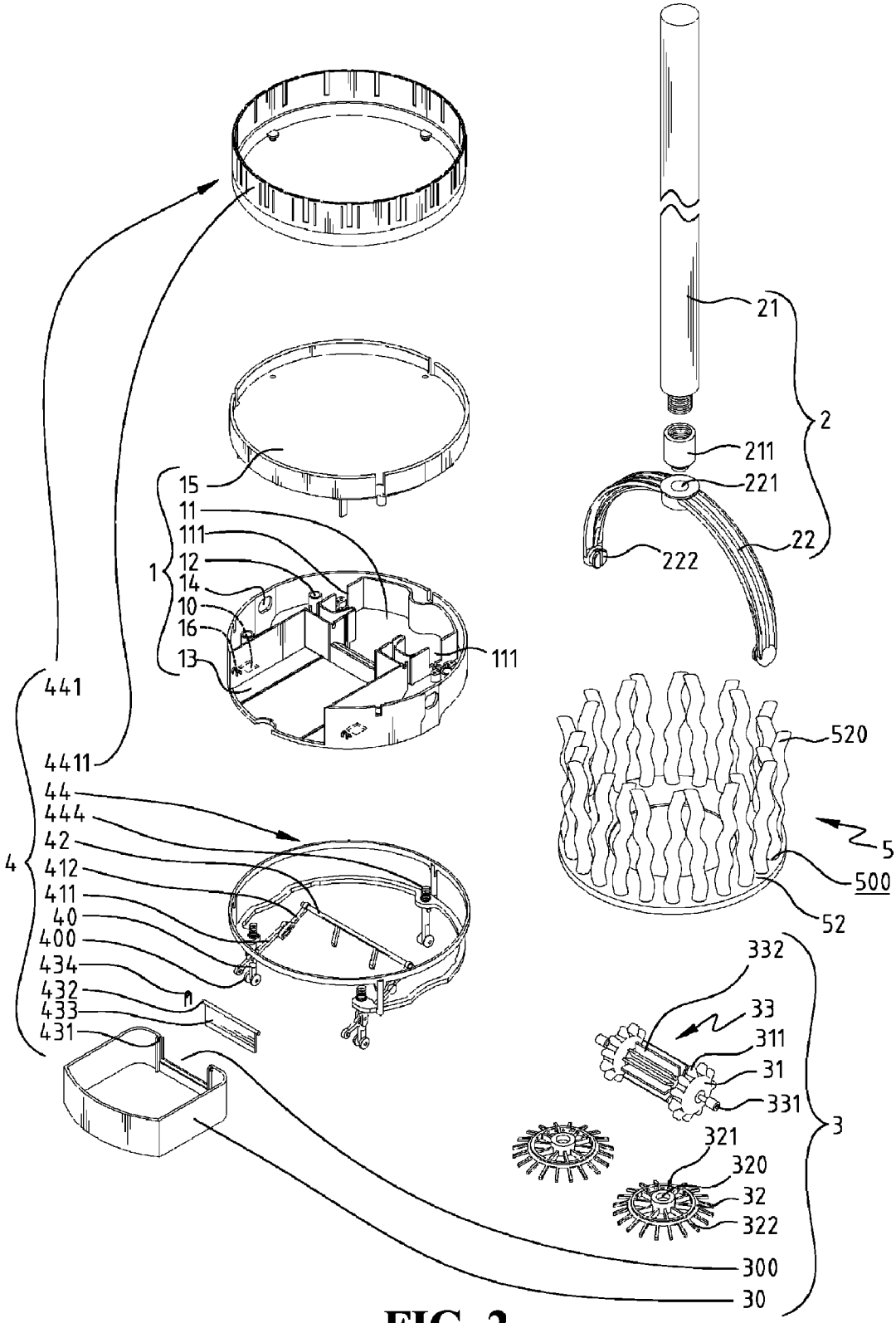
FIG. 2 is an exploded view showing the cleaning device according to the present invention.
Figure 3:
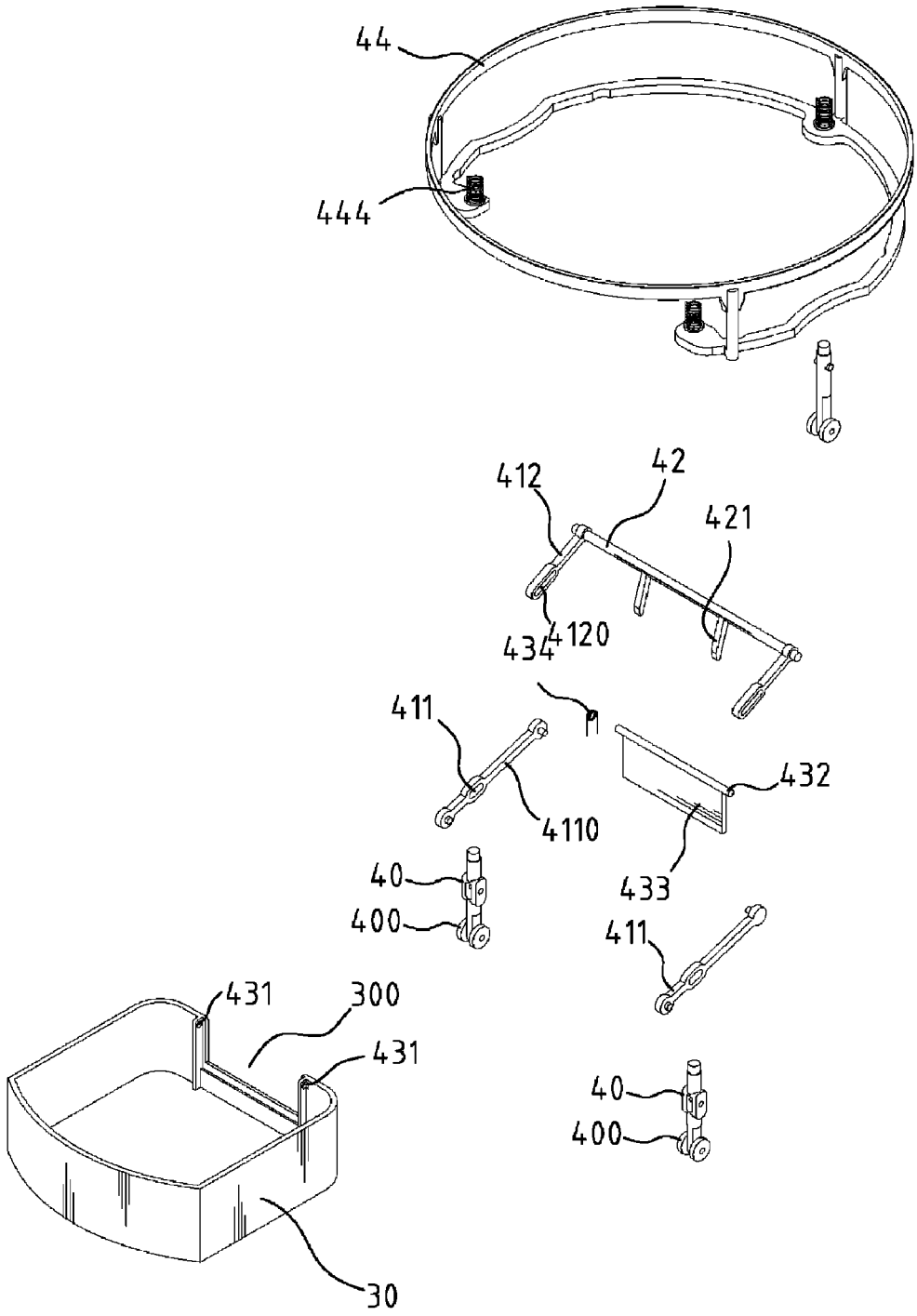
FIG. 3 is an exploded view showing a wheel unit of the cleaning device according to the present invention.
Figure 4:
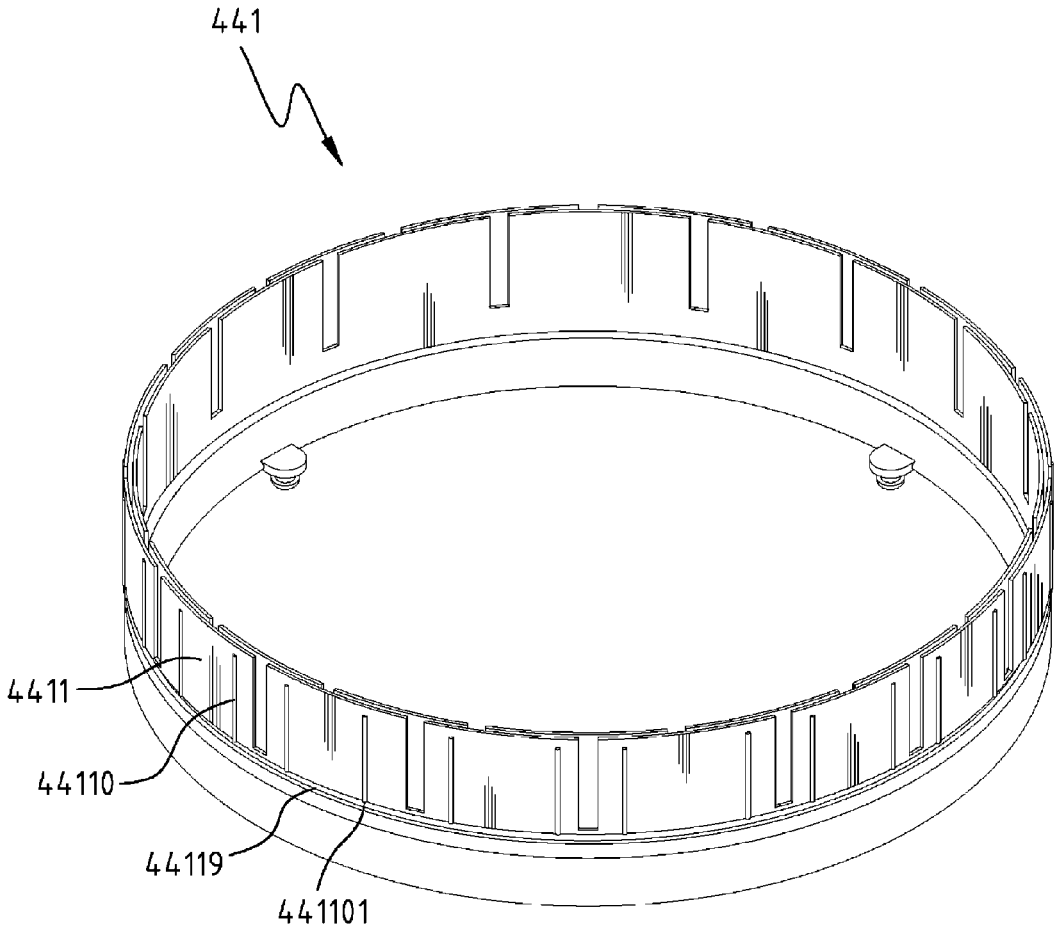
FIG. 4 is a perspective view showing a restriction ring of wheel unit in the cleaning device of the present invention.
Figure 5A:
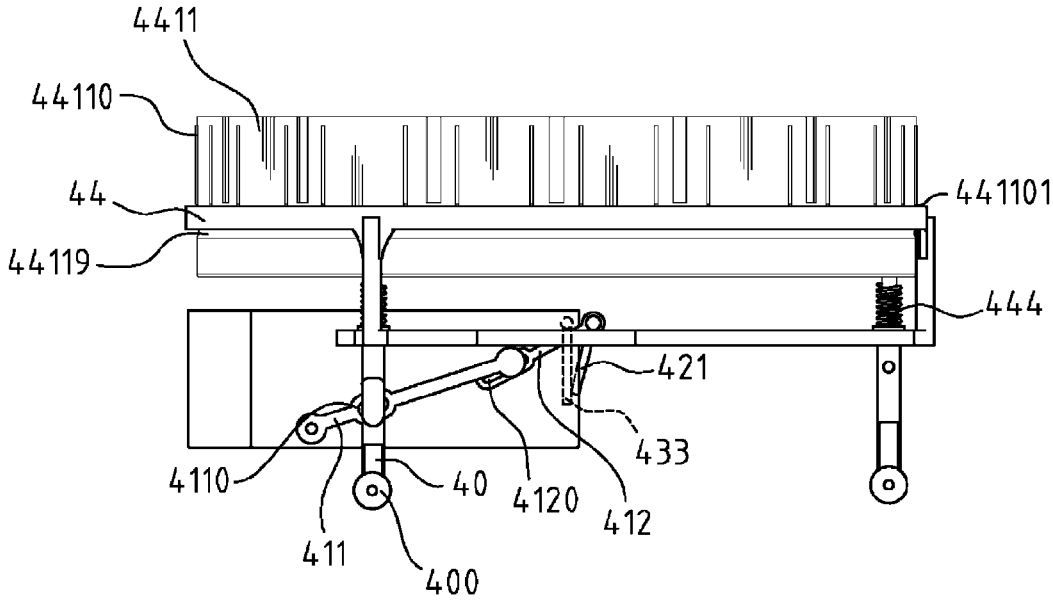
FIG. 5*a* is a side view showing the wheel unit before a handle unit is pushed down and a door is closed to prevent dust from dropping out from the cleaning device.
Figure 5B:
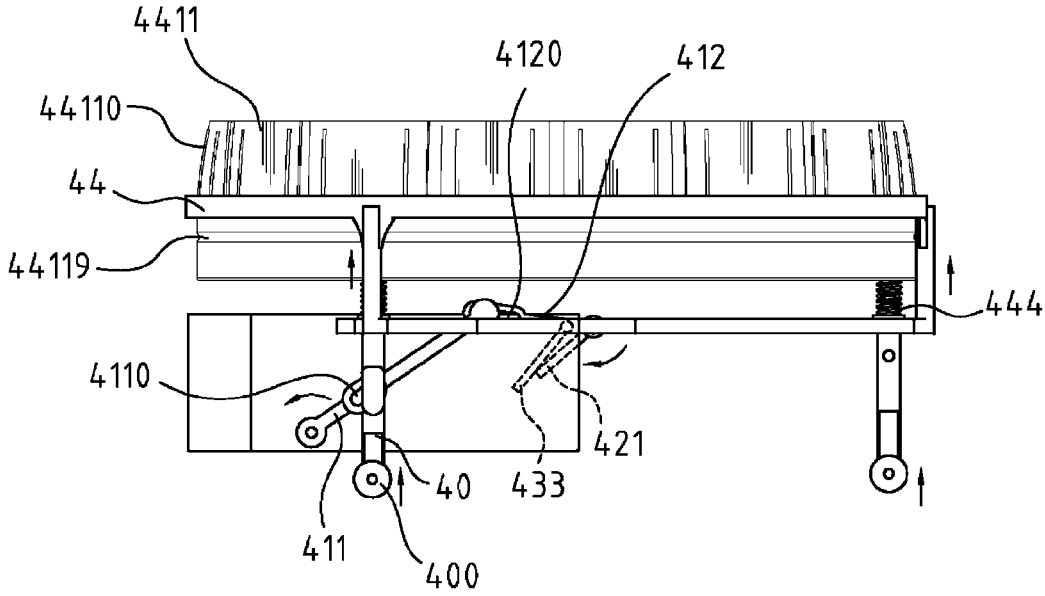
FIG. 5*b* is a side view showing the wheel unit after a handle unit is pushed down and the cleaning device is ready to sweep the floor.
Figure 6:
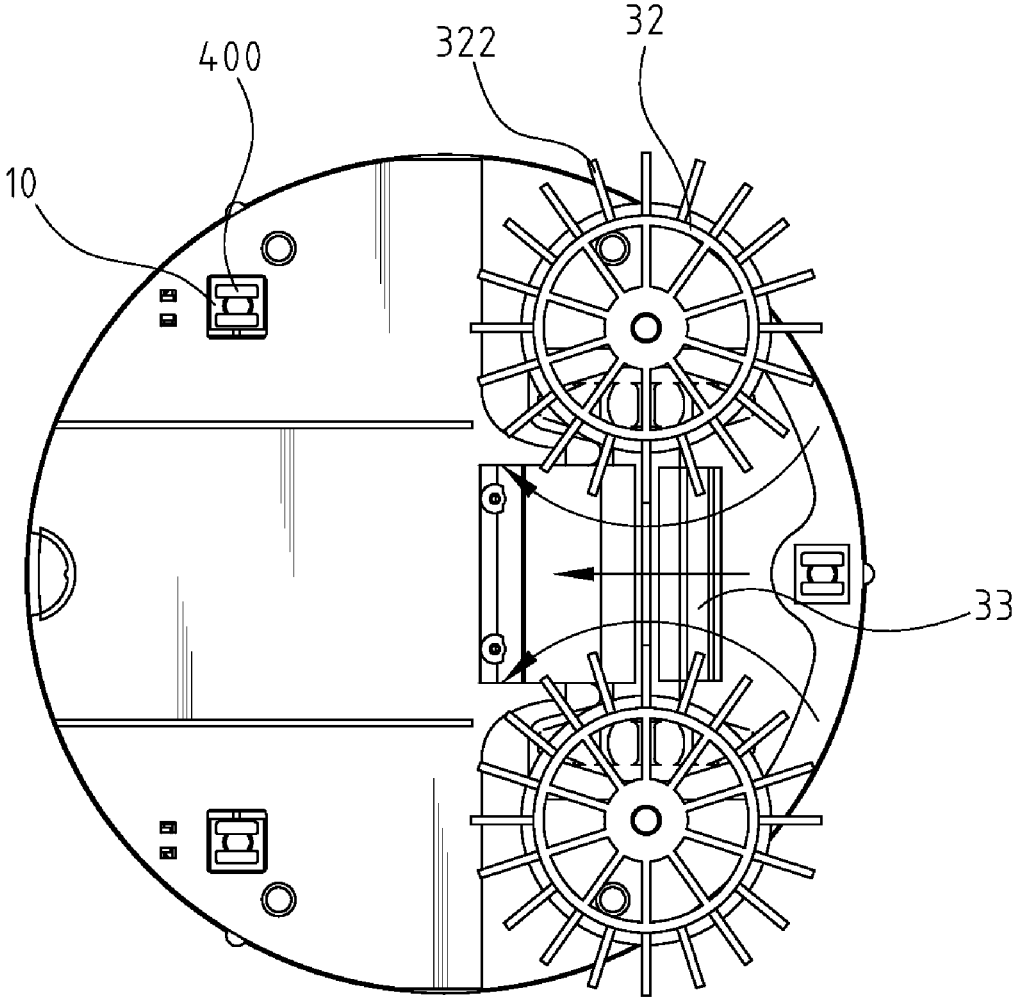
FIG. 6 is a bottom view showing the cleaning device during sweeping.

With reference to the drawings and in particular to FIGS. 1 to 4, a cleaning device in accordance with an embodiment of the present invention includes a case 1, a handle unit 2, a cleaning unit 3, a wheel unit 4 and a mopping unit 5. The case 1 has a sweeping space 11 and a chamber 13 which is located corresponding to the sweeping space 11. Two notches 111 are defined in two sidewalls of the sweeping space 11 and two tubes 12 are located besides the notches 111. Two first pivotal positions 16 are arranged to the case 1 and a plurality of second pivotal positions 14 are located in a peripheral wall of the case 1. A collar 15 is mounted to the case 1 and a plurality of openings 10 are defined in the case 1 and located corresponding to the collar 15.

The handle unit 2 comprises a handle 21 and a yoke member 22 connected with the handle 21. The handle 21 has an end connected with a connection member 211 which is pivotally connected to a reception hole 221 defined in a center of the yoke member 22. Two pivots 222 respectively extend from two ends of the yoke member 22 and are pivotally connected to the second pivotal positions 14 of the case 1.

The cleaning unit 3 comprises an elongate roller 33 and the roller 33 includes a plurality of plates 332 extending radially therefrom. The roller 33 has two roller shafts 331 on two ends thereof and the roller shafts 331 are engaged with the notches 111 of the case 1. Two gears 31 are connected to the two ends of the roller 33. Each gear 31 has a plurality of teeth 311 which protrude out from the case 1. Two cleaning disks 32 are driven by the gears 31 and each of the cleaning disks 32 has a central hole 320 and a plurality gaps 321 defined around the central hole 320. The teeth 311 of the gear 31 engage with the gaps 321 of the cleaning discs 32, and the teeth 311 extend through the gaps 321 and out of the case 1. The tubes 12 extend through the central holes 320 of the cleaning disks 32. Each of the cleaning disks 32 has a plurality of brushes 322. A collection box 30 is received in the chamber 13 and has an entrance 300 which faces the sweeping space 11.

The wheel unit 4 comprises a plurality of shanks 40 corresponding to the openings 10 and wheels 400 connected to the shanks 40. The shanks 40 extend through the openings 10 of the case 1 and pivotally connected to a first slot 4110 defined in a first link 411 which is connected to the case 1. A first end of the first link 411 is pivotally connected to a second slot 4120 defined in a first end of a second link 412 and a second end of the first link 411 is pivotally connected to the first pivotal position 16. A second end of the second link 412 is connected with a transverse rod 42 which has a plurality of pushers 421 extending therefrom. The entrance 300 is located between two end rods 431 and a shaft 432 is connected between the two end rods 431. A plurality of torsion springs 434 are located between the end rods 431 and the shaft 432. A door 433 is connected to the shaft 432 and the pushers 421 contact the door 433 which closes the entrance 300 of the collection box 30. By the torsion springs 434, the door 433 is kept to close the entrance 300 by the pushers 421. A frame 44 is mounted on the shanks 40. The frame 44 further includes a restriction ring 441 which is connected to the collar 15 or the mopping unit 5. The restriction ring 441 includes wall pieces 4411 extending therefrom and the wall pieces are partially overlapped to each other. The wall pieces 4411 has ribs 44110 on an outside thereof. Inclined surfaces 441101 are defined on the ribs 44110 and located close to the frame 44. The wall pieces 4411 are made of deformable material. A groove 44119 is defined on an outside of the wall piece 4411 and adjacent to the inclined surface 441101 of the rib 44110. A plurality of springs 444 are disposed between the shanks 40 and the case 1.

The mopping unit 5 comprises a board 52 with a plurality of through holes 500 through which the mopping members 520 are connected. The board 52 is connected to the collar 15 of the case 1. The mopping members 520 can be fabric braids or sponges.

Referring to FIGS. 3, 4, 5*a*, 5*b* and 6, When the cleaning unit 3 contacts the floor, the shanks 40 and the wheels 400 contact the floor and push the case 1 upward so as to activate the first and second links 411, 412 to drive the transverse rod 42 and the pushers 421 to push open the door 433 of the collection box 30. In the meanwhile, the shanks 40 also push the frame 44 upward and the frame 44 move to the ribs 44110 via the inclined surfaces 441101. Because the ribs 44110 have a certain thickness so that the wall pieces 4411 of the restriction ring 441 are deformed inward about the grooves 44119 when the frame 44 encloses the wall pieces 4411. The mopping members 520 are then restricted by the wall pieces 4411 and do not affect the sweeping action. Then, the user moves the case 1, and the teeth 311 contact the floor and rotate the gears 31. Thus, the cleaning disks 32 are rotated, and the brushes 322 of the cleaning disks 32 brush dust through the entrance 300 into the collection box 30. The plates 332 of the roller 33 are rotated and keep the dust from spreading. When the collection box 30 is filled up with dust and debris, the user may remove the connection box 30 from the chamber 13 to clean the collection box 30.

Figure 7:
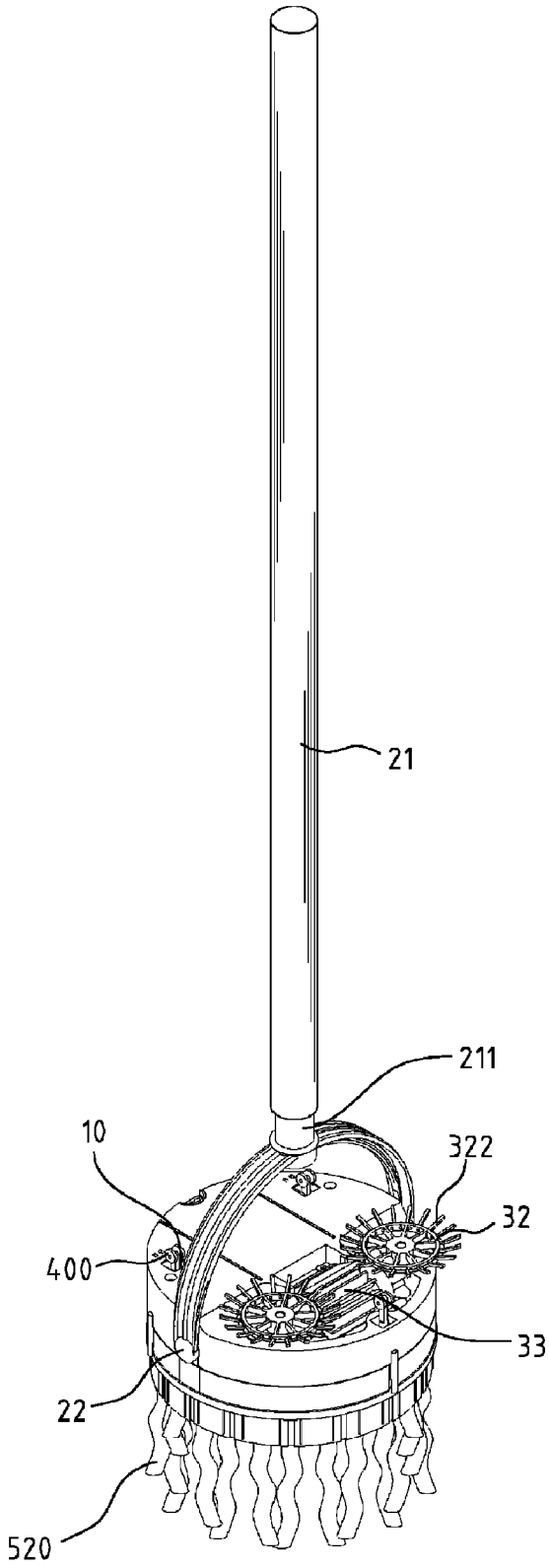
FIG. 7 is a bottom view showing the cleaning device during mopping.

Referring to FIG. 7, after sweeping, the user lifts the handle 21, and the case 1 is rotated 180 degrees around the pivots 222 to allow the mopping unit 5 to face the floor. The frame 44 returns to its original position because the springs 444 move the shanks 40 away from the case 1. The mopping members 520 are released from the restriction ring 441 and can be used to mop the floor. The board 52 of the mopping unit 5 can be connected to or remove from the case 1 so as to be replaced or to clean the mopping members 520. The pivots 222 on the yoke member 22 are connected to the second pivotal positions 14 of the case 1 so that the user can hold the handle 21 and operate the cleaning device. When the user lifts the case 1, the wheels 400 and the shanks 40 push the door 433 to close the entrance 300 of the collection box 30 because of the torsion springs 434 located between the end rods 431 and the shaft 432. The shanks 40 and the wheels 400 are then protruded beyond the case 1 due to linkage between the pushers 421, the transverse rod 42, the second links 412 and the first links 411. The door 433 prevents the dust in the collection box 30 from dropping out from the entrance 300. The collection box 30 can be removed from the case 1 via the chamber 13.

The cleaning device according to the present invention integrates the cleaning unit 3 and the mopping unit 5 together and thus the cleaning device is easy to organize and occupies less space. The door 433 effectively prevents the dust from dropping from the collection box 30.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A cleaning device, comprising:

a case having a sweeping space, a chamber located corresponding to the sweeping space, a collar mounted to the case and a plurality of first pivotal positions arranged to the case;

a handle unit having a handle and a yoke member connected to an end of the handle, two ends of the yoke member pivotally connected to the case;

a cleaning unit having an elongate roller and the roller including a plurality of plates extending radially therefrom, the roller pivotally connected to the case and two gears connected to the roller, each of the gears having a plurality of teeth which protrude out from the case, a plurality of cleaning disks driven by the gears and each of the cleaning disks having a central hole and a plurality of gaps defined around the central hole, the teeth engaging with the gaps and removably extending through the gaps, each of the cleaning disks having a plurality of brushes, a collection box received in the chamber and having an entrance which faces the sweeping space;

a wheel unit having a plurality of shanks and wheels connected to the shanks, the shanks disposed at a same side with the cleaning device, the shanks pivotally connected to a first slot defined in a first link which is connected to the case, a first end of the first link pivotally connected to a second slot defined in a first end of a second link, a second end of the first link pivotally connected to the first pivotal position of the case, a second end of the second link connected with a transverse rod which has a plurality of pushers extending therefrom, the entrance located between two end rods between which a shaft is connected, a plurality of torsion springs located between the end rods and the shaft, a door connected to the shaft and the pushers contacting the door which is capable of closing the entrance of the collection box; and a mopping unit having a board with multiple mopping members connected thereto and the board connected to the collar of the case.

2. The cleaning device as claimed in claim 1, wherein two notches are defined in two sidewalls of the sweeping space and two tubes are located besides the notches, two second pivotal positions are located in a peripheral wall of the case, the tubes extend through the central holes of the cleaning disks.

3. The cleaning device as claimed in claim 2, wherein the case has a plurality of openings through which the shanks and the wheels extend.

4. The cleaning device as claimed in claim 2, wherein the roller includes a plurality of roller shafts which are engaged with the notches of the case.

5. The cleaning device as claimed in claim 1, wherein the case has a plurality of openings through which the shanks and the wheels extend.

6. The cleaning device as claimed in claim 1, wherein the roller includes a plurality of roller shafts which are engaged with the case.

7. The cleaning device as claimed in claim 1, wherein the transverse rod and the pushers contact with the door.

8. The cleaning device as claimed in claim 1, wherein the wheel unit further includes a restriction ring which is connected to the collar or the board, a frame is mounted on the shanks, the restriction ring contacts with the frame, a plurality of springs are located between the shanks and the case, the restriction ring includes a plurality of wall pieces extending therefrom.

9. The cleaning device as claimed in claim 8, wherein the wall pieces are made of deformable material.

10. The cleaning device as claimed in claim 8, wherein the wall pieces are partially overlapped to each other and located adjacent to the collar or the board.

11. The cleaning device as claimed in claim 8, wherein the wall pieces have a plurality of ribs on an outside thereof and inclined surfaces are defined on the ribs located close to the frame.

12. The cleaning device as claimed in claim 8, wherein at least one groove is defined in an outside of the wall piece.

13. The cleaning device as claimed in claim 1, wherein the board includes a plurality of through holes through which the mopping members are connected.

* * * * *